US011085743B2

(12) United States Patent
Buchanan

(10) Patent No.: US 11,085,743 B2
(45) Date of Patent: Aug. 10, 2021

(54) ARROWHEAD

(71) Applicant: Howard Andrew Buchanan, Burnsville, NC (US)

(72) Inventor: Howard Andrew Buchanan, Burnsville, NC (US)

(73) Assignee: Centercross Archery LLC., Burnsville, NC (US)

( * ) Notice: Subject to any disclaimer, the term of this patent is extended or adjusted under 35 U.S.C. 154(b) by 0 days.

(21) Appl. No.: 16/734,342

(22) Filed: Jan. 5, 2020

(65) Prior Publication Data

US 2020/0300589 A1 Sep. 24, 2020

Related U.S. Application Data

(60) Provisional application No. 62/919,636, filed on Mar. 21, 2019.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 4,986,550 A * 1/1991 Segovia ..... F42B 6/08 473/584
4,998,738 A * 3/1991 Puckett ..... F42B 6/08 473/583
5,078,407 A * 1/1992 Carlston ..... F42B 6/08 473/583
5,082,292 A * 1/1992 Puckett ..... F42B 6/08 473/583
5,112,063 A * 5/1992 Puckett ..... F42B 6/08 473/583
5,160,148 A * 11/1992 Musacchia, Sr. ..... F42B 6/08 30/303
5,172,916 A * 12/1992 Puckett ..... F42B 6/08 473/583
5,931,751 A * 8/1999 Cooper ..... F42B 6/08 473/583
6,077,180 A * 6/2000 Adams, Jr. ..... F42B 6/08 473/584
6,258,000 B1 * 7/2001 Liechty, II ..... F42B 6/08 473/583
6,530,853 B1 * 3/2003 Giannetti ..... F42B 6/08 473/584
6,669,586 B2 * 12/2003 Barrie ..... F42B 6/08 473/583
7,179,182 B2 * 2/2007 Summers ..... F42B 6/08 473/583

(Continued)

*Primary Examiner* — Alexander R Niconovich
(74) *Attorney, Agent, or Firm* — Robert C. Corbett; Technology Law, PLLC

(57) ABSTRACT

An arrowhead includes a ferrule member and four blade members. The ferrule member defines an outer surface, a chamber, and first, second, third, fourth, fifth, sixth, seventh, and eighth slots that extend from the chamber to the outer surface. A first blade member extends through the first and second slots; a second blade member extends through the third and fourth slots; a third blade member extends through the fifth and sixth slots; and a fourth blade member extends through the seventh and eighth slots.

9 Claims, 4 Drawing Sheets

(56) References Cited

U.S. PATENT DOCUMENTS

| | | | | |
|---|---|---|---|---|
| 7,713,152 | B1 * | 5/2010 | Tentler | F42B 6/08 473/583 |
| 7,871,345 | B2 * | 1/2011 | Cooper | F42B 6/08 473/584 |
| 8,043,178 | B2 * | 10/2011 | Sarnes | F42B 6/08 473/583 |
| 8,100,788 | B2 * | 1/2012 | Sanford | F42B 6/08 473/584 |
| 8,147,361 | B1 * | 4/2012 | Weaver | F42B 6/08 473/583 |
| 8,926,457 | B2 * | 1/2015 | Treto | F42B 6/08 473/583 |
| 9,046,331 | B1 * | 6/2015 | Mallo | F42B 6/08 |
| 9,410,777 | B2 * | 8/2016 | Martin | F42B 6/08 |
| 9,879,955 | B2 | 1/2018 | Rowley | |
| 10,030,949 | B1 * | 7/2018 | Grace | F42B 6/08 |
| 10,082,373 | B2 * | 9/2018 | Romero | F42B 6/08 |
| 2003/0153417 | A1 * | 8/2003 | Barrie | F42B 6/08 473/583 |
| 2009/0233742 | A1 * | 9/2009 | Sanford | F42B 6/08 473/584 |
| 2013/0237350 | A1 * | 9/2013 | Rager | C21D 9/0068 473/584 |
| 2017/0219322 | A1 * | 8/2017 | Huntsman | F42B 6/08 |

* cited by examiner

ARROWHEAD

CROSS REFERENCE TO RELATED APPLICATION

This application claims the benefit of U.S. Provisional Patent Application No. 62/919,636, filed Mar. 21, 2019, and which is hereby incorporated by reference in its entirety.

BACKGROUND OF THE INVENTION

The instant invention relates to broadhead arrow points. U.S. Pat. No. 9,879,955 discloses, for example, an expanding blade broadhead arrow point. U.S. Pat. No. 8,043,178 discloses a unique broadhead arrow point comprising a ring shaped blade. Despite the many advances made in the art of broadhead arrow points, there remains a need for improved broadhead arrow points.

SUMMARY

According to a first aspect of the invention, a broadhead arrowhead includes eight or more exposed blades, each of which blades are equally radially spaced from each other. The broadhead of the instant invention is more accurate and more stable than prior art broadheads. According to a second aspect of the invention, a broadhead arrow point includes exposed blades centered by inserts engaging with notches positioned in the center of the blades.

The above features and advantages and other features and advantages of the present disclosure are readily apparent from the following detailed description of the best modes for carrying out the disclosure when taken in connection with the accompanying drawings

DETAILED DESCRIPTION

Figure 1:
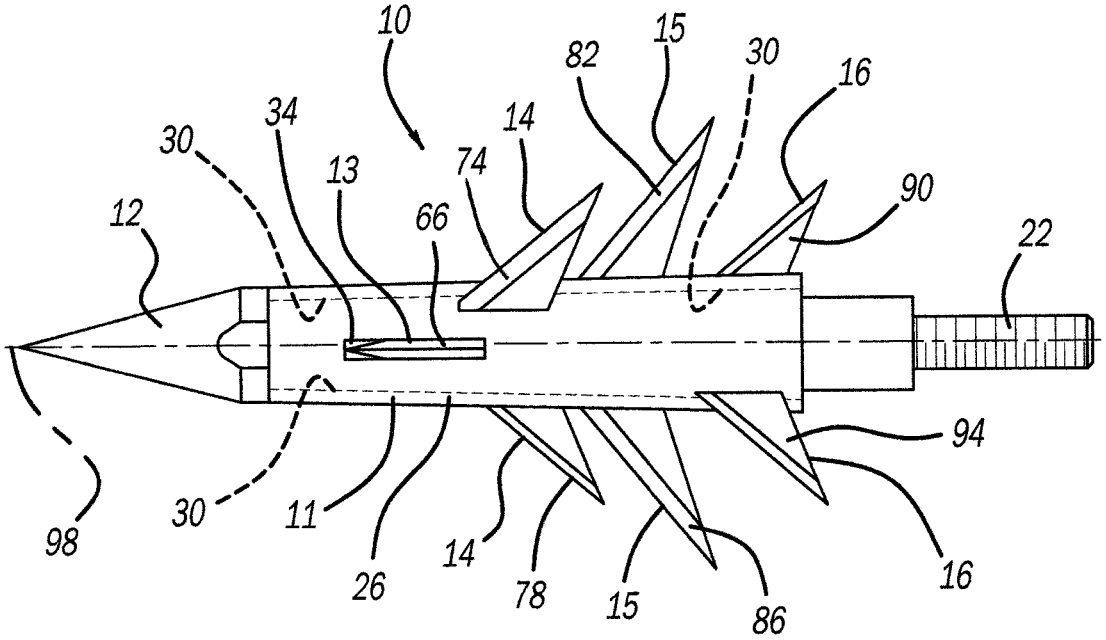
FIG. 1 is a schematic, side view of an arrowhead in accordance with the claimed invention.
Figure 2:
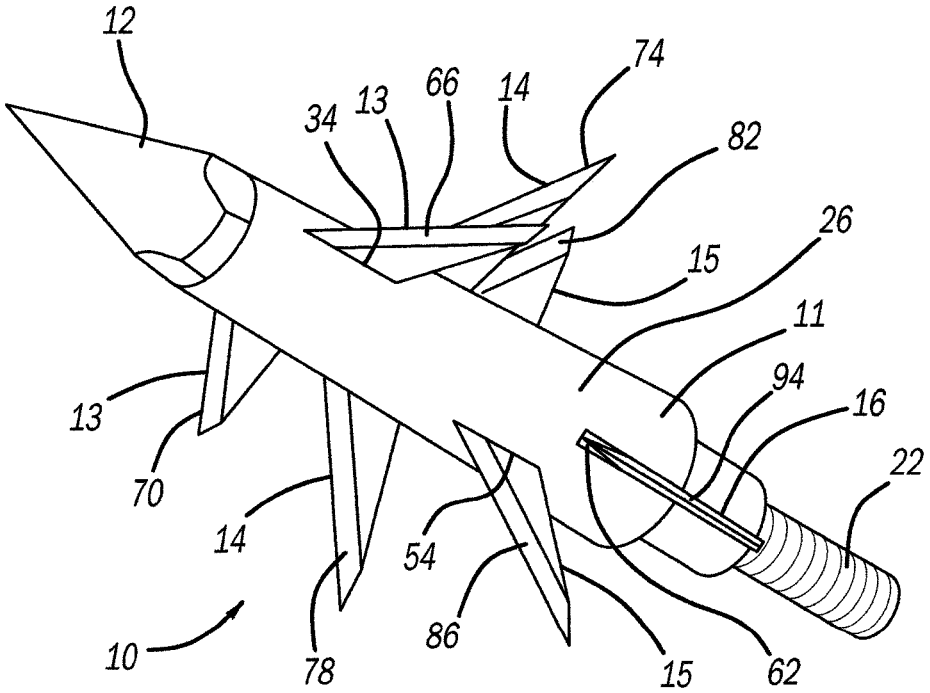
FIG. 2 is a schematic, perspective view of the arrowhead of FIG. 1.
Figure 3:
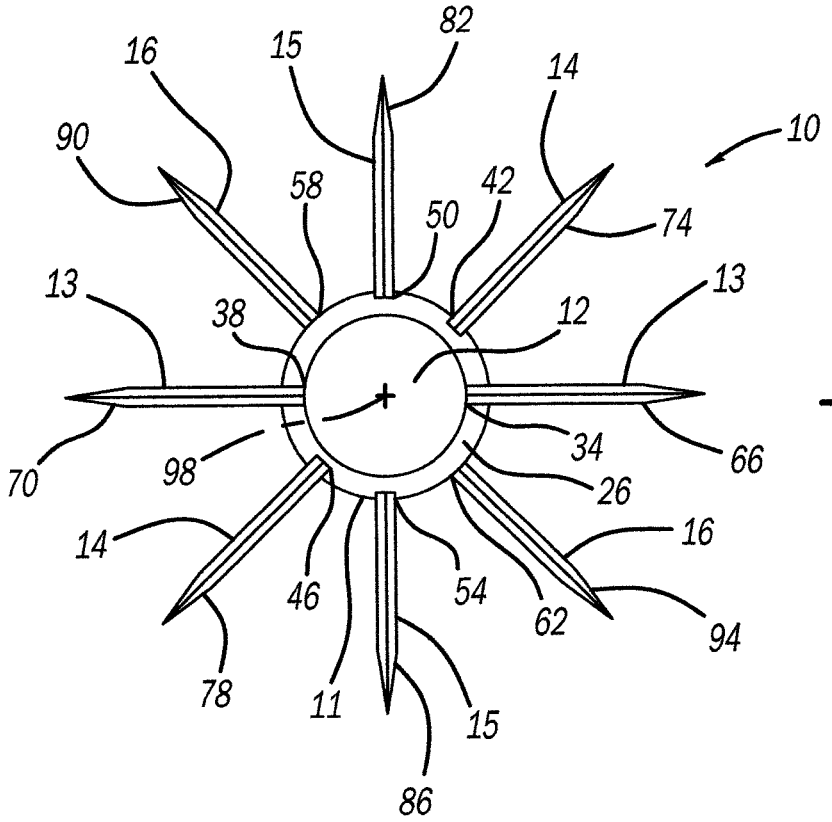
FIG. 3 is a schematic, end view of the arrowhead of FIG. 1.

Referring now to FIGS. 1-4, wherein like reference numbers refer to like components throughout, therein is shown an arrowhead 10. Arrowhead 10 is comprised of ferrule 11 adapted to receive tip 12 at one end and with a threaded shank 22 to be screwed into an arrow at the other end. Blade members 13, 14, 15 and 16 are positioned in slots cut into ferrule 11. As best seen in FIG. 3, blade members 13, 14, 15 and 16 are equally radially spaced from each other.

Figure 4:
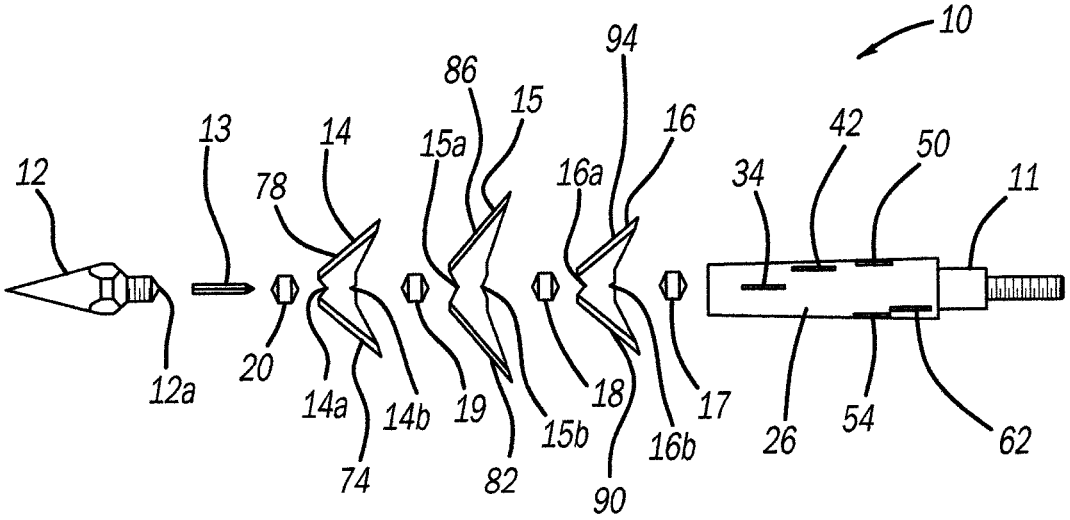
FIG. 4 is a schematic, exploded, side view of the arrowhead of FIG. 1.
Figure 5:
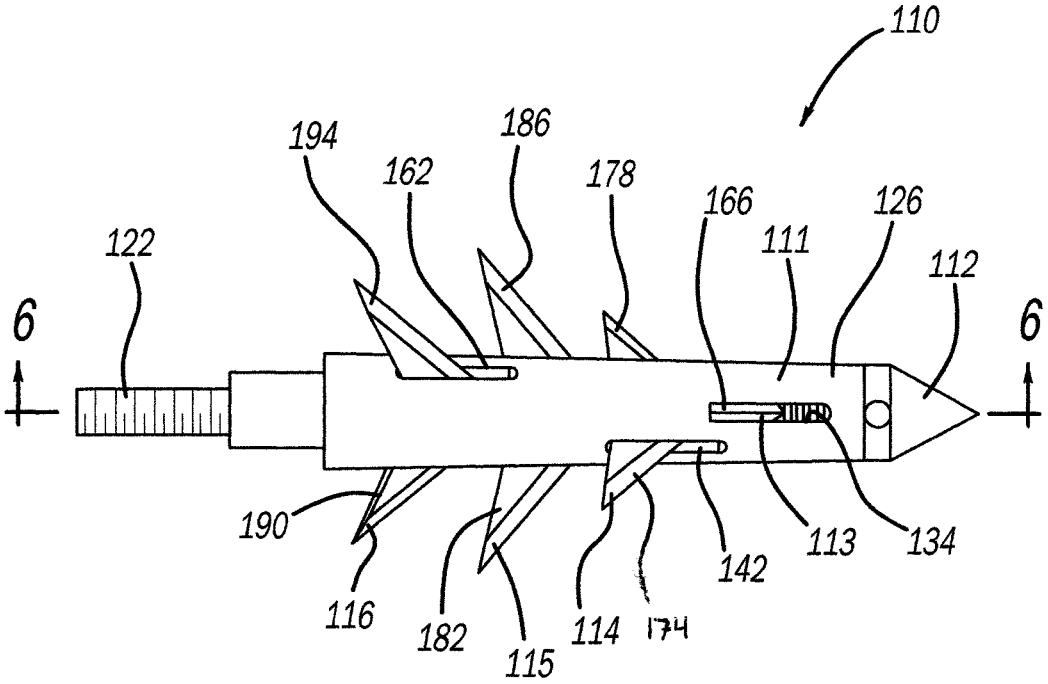
FIG. 5 is a schematic, side view of another arrowhead in accordance with the claimed invention.

Referring specifically to FIG. 4, cone tipped inserts 17, 18, 19 and 20 center blade members 13, 14, 15 and 16 by way of notches 14*a*, 14*b*, 15*a*, 15*b*, 16*a*, 16*b*, 17*a* and 17*b* in blade members 14, 15, 16 and 17 respectively. Blade 13 is similarly notched and centered by cone tipped insert 20 and cone 12*a* of tip 12.

Thus, the arrowhead 10 includes a member, i.e., ferrule 11, that defines an outer surface 26, a chamber 30, a first slot 34, second slot 38, third slot 42, fourth slot 46, fifth slot 50, sixth slot 54, seventh slot 58, and eighth slot 62. Each of the slots 34, 38, 42, 46, 50, 54, 58, 62 extends from the outer surface 26 to the chamber 30. The first blade member 13 extends through the first and second slots 34, 38 and the chamber 30. The second blade member 14 extends through the third and fourth slots 42, 46 and the chamber 30. The third blade member 15 extends through the fifth and sixth slots 50, 54. The fourth blade member 16 extends through the seventh and eighth slots 58, 62 and the chamber 30.

The first blade member 13 defines first and second blades 66, 70; the second blade member 14 defines third and fourth blades 74, 78; the third blade member 15 defines fifth and sixth blades 82, 86; and the fourth blade member 16 defines seventh and eighth blades 90, 94. Each of the blades 66, 70, 74, 78, 82, 86, 90, 94 extends radially outward from the centerline 98 of the ferrule 11. More specifically, the slots 34-62 are positioned such that the first, second, third, and fourth blade members 13, 14, 15, 16 are spaced apart from each other in the longitudinal direction relative to the ferrule 11 (i.e., along the centerline 98). Each of the first, second, third, and fourth blade members 13, 14, 15, 16 intersects the centerline 98 such that the first, second, third, fourth, fifth, sixth, seventh, and eighth blades 66, 70, 74, 78, 82, 86, 90, 94 extend radially from the centerline 98.

The slots 34-62 are arranged angularly such that the first, second, third, and fourth blade members 13, 14, 15, 16 are substantially evenly spaced angularly around the centerline, as best seen in FIG. 3. In other words, a first plane extends through the first blade member 13, including through blades 66, 70; a second plane extends through the second blade member 14, including through blades 74, 78; a third plane extends through the third blade member 15, including through blades 82, 86; and a fourth plane extends through the fourth blade member 16, including through blades 90, 94. All four planes also intersect with each other at the centerline 98. The first plane, i.e., the plane through the first blade member 13, and the second plane, i.e., the plane through the second blade member 14, form a forty-five degree angle therebetween. The second plane and the third plane, i.e., the plane through the third blade member 15, form a forty-five degree angle therebetween. The third plane and the fourth plane, i.e., the plane through the fourth blade member 16, also form a forty-five degree angle therebetween.

The cone-tipped inserts 17, 18, 19, 20 function as first, second, third, and fourth spacing members inside the chamber 30. More specifically, the first spacing member 20 is between the first and second blade members 13, 14; the second spacing member 19 is between the second and third blade members 14, 15; the third spacing member 18 is between the third and fourth blade members 15, 16; and the fourth spacing member 17 is between the fourth blade member 16 and an end of the chamber 30.

The first blade member 13 defines a first notch and the second blade defines a second notch 14*a*; the first spacing member 20 extends into the first and second notches 14*a*. The second blade member 14 defines a third notch 14*b* and the third blade 15 member defines a fourth notch 15*a*; the second spacing member 19 extends into the third and fourth notches 14*b*, 15*a*. The third blade member 15 defines a fifth notch 15*b* and the fourth blade member 16 defines a sixth notch 16*a*; the third spacing member 18 extends into the fifth and sixth notches 15*b*, 16*a*. The fourth blade member 16 defines a seventh notch 16*b*; the fourth spacing member 17 extends into the seventh notch 16*b*.

Figure 6:
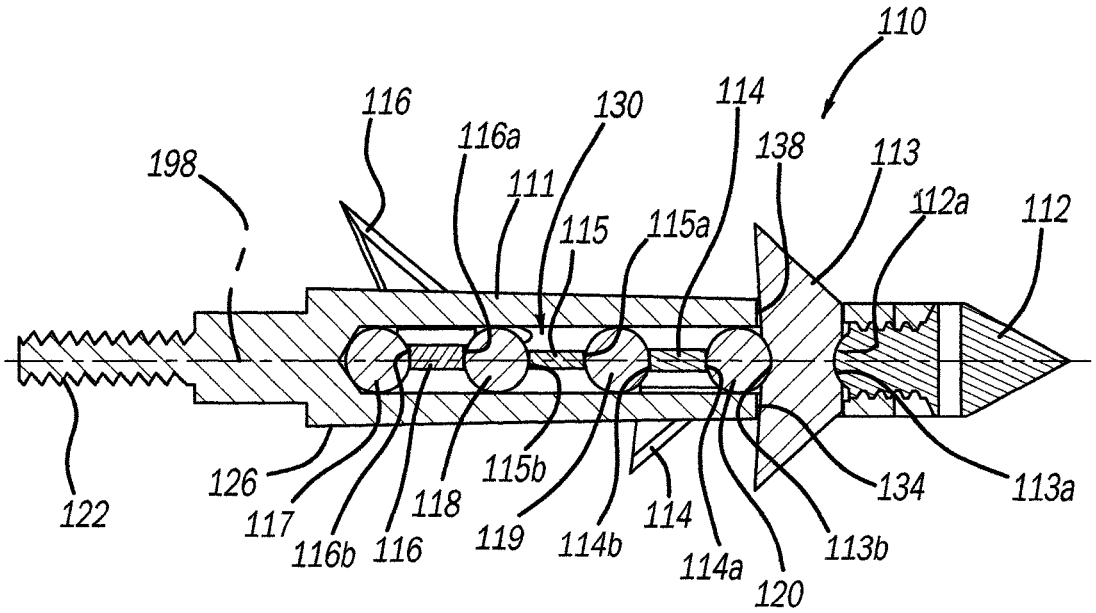
FIG. 6 is a schematic, sectional, side view of the arrowhead of FIG. 5.
Figure 7:
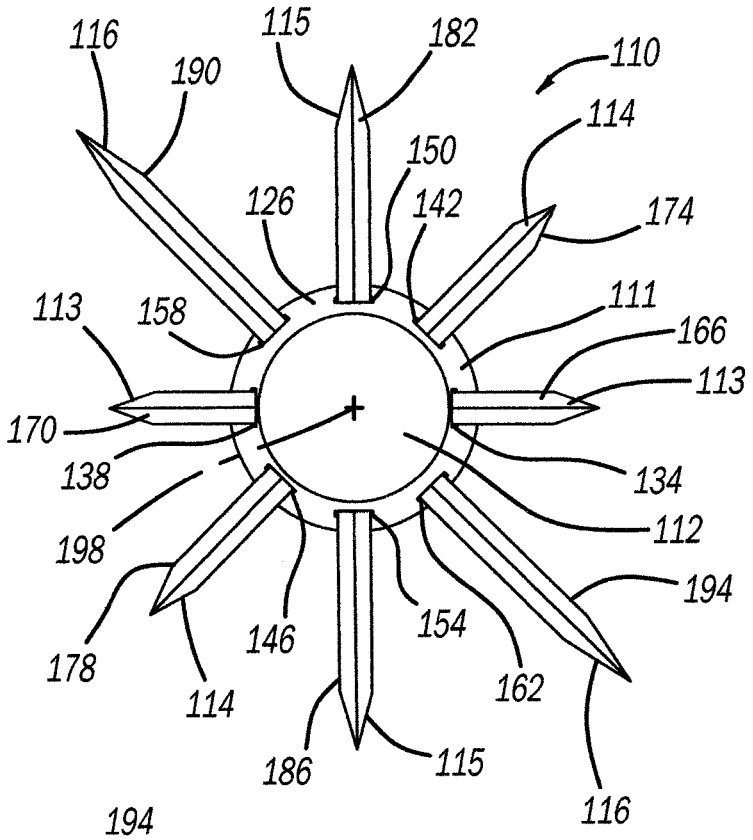
FIG. 7 is a schematic, end view of the arrowhead of FIG. 5.
Figure 8:
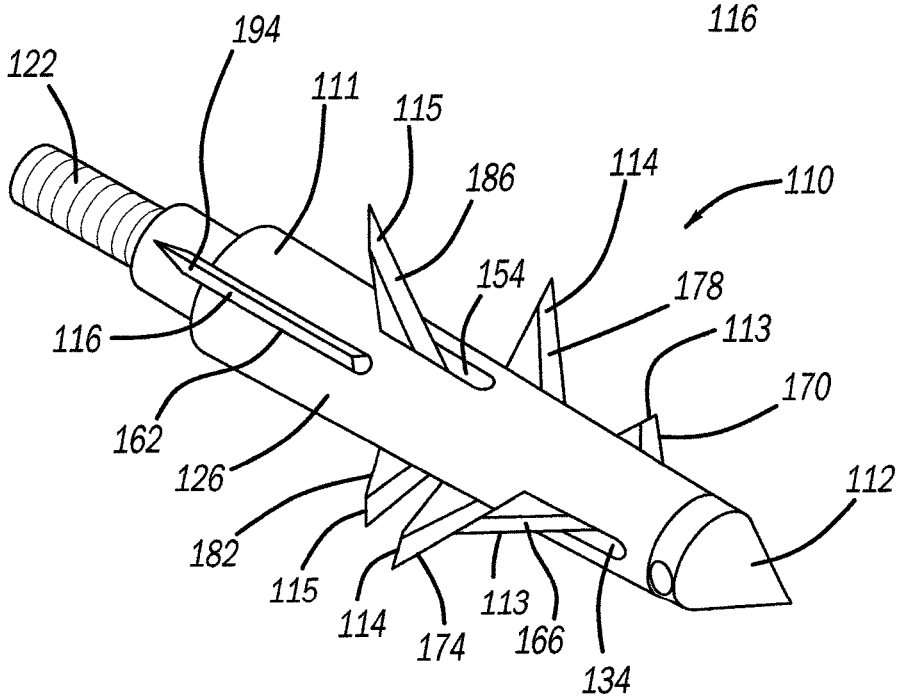
FIG. 8 is a schematic, perspective view of the arrowhead of FIG. 5.

Referring to FIGS. 5-8, wherein like reference numbers refer to like components from FIGS. 1-4, another embodiment of the arrowhead 110 is schematically depicted. Arrowhead 110 is comprised of ferrule 111 adapted to receive tip 112 at one end and with a threaded shank 122 to be screwed into an arrow at the other end. Blade members 113, 114, 115 and 116 are positioned in slots cut into ferrule 111. As best seen in FIG. 7, blade members 113, 114, 115 and 116 are equally radially spaced from each other.

Referring specifically to FIG. 6, inserts, or spacing members 117, 118, 119 and 120 center blade members 113, 114, 115 and 116 by way of notches 113*a*, 113*b*, 114*a*, 114*b*, 115*a*, 115*b*, 116*a*, 116*b*, 117*a* and 117*b* in blade members 113, 114, 115, 16 and 117 respectively. Spherical segment 112*a* of tip 112 engages notch 113*a* in blade member 113.

Thus, the arrowhead 110 includes a member, i.e., ferrule 111, that defines an outer surface 126, a chamber 130, a first slot 134, second slot 138, third slot 142, fourth slot 146, fifth slot 150, sixth slot 154, seventh slot 158, and eighth slot 162. In the embodiment of FIGS. 5-8, the outer surface 126 and the chamber 130 are cylindrical or frusto-conical. Each of the slots 134, 138, 142, 146, 150, 154, 158, 162 extends from the outer surface 126 to the chamber 130. The first blade member 113 extends through the first and second slots 134, 138 and the chamber 130. The second blade member 114 extends through the third and fourth slots 142, 146 and the chamber 130. The third blade member 115 extends through the fifth and sixth slots 150, 154. The fourth blade member 116 extends through the seventh and eighth slots 158, 162 and the chamber 130.

The first blade member 113 defines first and second blades 166, 170; the second blade member 114 defines third and fourth blades 174, 178; the third blade member 115 defines fifth and sixth blades 182, 186; and the fourth blade member 116 defines seventh and eighth blades 190, 194. Each of the blades 166, 170, 174, 178, 182, 186, 190, 194 extends radially outward from the centerline 198 of the ferrule 11. More specifically, the slots 134-162 are positioned such that the first, second, third, and fourth blade members 113, 114, 115, 116 are spaced apart from each other in the longitudinal direction relative to the ferrule 111 (i.e., along the centerline 198). Each of the first, second, third, and fourth blade members 113, 114, 115, 116 intersects the centerline 98 such that the first, second, third, fourth, fifth, sixth, seventh, and eighth blades 166, 170, 174, 178, 182, 186, 190, 194 extend radially from the centerline 198.

The slots 134-162 are arranged angularly such that the first, second, third, and fourth blade members 113, 114, 115, 116 are substantially evenly spaced angularly around the centerline, as best seen in FIG. 7. In other words, a first plane extends through the first blade member 113, including through blades 166, 170; a second plane extends through the second blade member 114, including through blades 174, 178; a third plane extends through the third blade member 115, including through blades 182, 186; and a fourth plane extends through the fourth blade member 116, including through blades 190, 194. All four planes also intersect with each other at the centerline 198. The first plane, i.e., the plane through the first blade member 113, and the second plane, i.e., the plane through the second blade member 114, form a forty-five degree angle therebetween. The second plane and the third plane, i.e., the plane through the third blade member 115, form a forty-five degree angle therebetween. The third plane and the fourth plane, i.e., the plane through the fourth blade member 116, also form a forty-five degree angle therebetween.

The spacing members 117, 118, 119, 120 are spherical in the embodiment depicted in FIGS. 5-8 and may, for example, ball bearings. The first spacing member 120 is between the first and second blade members 113, 114; the second spacing member 119 is between the second and third blade members 114, 115; the third spacing member 118 is between the third and fourth blade members 115, 116; and the fourth spacing member 117 is between the fourth blade member 116 and an end of the chamber 130.

The first blade member 113 defines a first notch 113*b* and the second blade defines a second notch 114*a*; the first spacing member 120 extends into the first and second notches 113*b*, 114*a*. The second blade member 114 defines a third notch 114*b* and the third blade 115 member defines a fourth notch 115*a*; the second spacing member 119 extends into the third and fourth notches 114*b*, 115*a*. The third blade member 115 defines a fifth notch 115*b* and the fourth blade member 116 defines a sixth notch 116*a*; the third spacing member 118 extends into the fifth and sixth notches 115*b*, 116*a*. The fourth blade member 116 defines a seventh notch 116*b*; the fourth spacing member 117 extends into the seventh notch 116*b*. As best seen in FIG. 7, the second blade member 114 is longer than the first blade member 113, the third blade member 115 is longer than the second blade member 114, and the fourth blade member 116 is longer than the third blade member 115.

The components of the instant invention can be made of any suitable material. Blades 13, 14, 15 and 16 are preferably made of a steel alloy as is tip 12 and inserts 17, 18, 19 and 20. Ferrule 11 is preferably made of an aluminum alloy. The eight or more exposed blades of the instant invention, each of which blades are equally radially spaced from each other, provides a surprisingly increased accuracy for arrows using the instant invention. The use of notched blades in cooperation with the tipped inserts centers the blades in the ferrule.

While the best modes for carrying out the disclosure have been described in detail, those familiar with the art to which this disclosure relates will recognize various alternative designs and embodiments for practicing the disclosure within the scope of the appended claims.

The invention claimed is:

1. An apparatus comprising:

a member defining an outer surface, a chamber, and first, second, third, fourth, fifth, sixth, seventh, and eighth slots extending from the outer surface to the chamber;

a first blade member extending through the first and second slots;

a second blade member extending through the third and fourth slots;

a third blade member extending through the fifth and sixth slots; and a fourth blade member extending through the seventh and eighth slots;

said first, second, third, and fourth blade members being separate and distinct from one another.

2. The apparatus of claim 1, wherein the first blade member defines first and second blades;

wherein the second blade member defines third and fourth blades;

wherein the third blade member defines fifth and sixth blades; and wherein the fourth blade member defines seventh and eighth blades.

3. The apparatus of claim 2, wherein the first, second, third, and fourth blade members are spaced apart from each other in the longitudinal direction relative to the member;

wherein the member is characterized by a centerline;

wherein each of said first, second, third, and fourth blade members intersect the centerline such that the first, second, third, fourth, fifth, sixth, seventh, and eighth blades extend radially from the centerline; and wherein the first, second, third, and fourth blade members are substantially evenly spaced angularly around the centerline.

4. The apparatus of claim 3, further comprising first, second, third, and fourth spacing members inside the chamber;

wherein the first spacing member is between the first and second blade members;

wherein the second spacing member is between the second and third blade members;

wherein the third spacing member is between the third and fourth blade members; and wherein the fourth spacing member is between the fourth blade member and an end of the chamber.

5. The apparatus of claim 4, wherein the first blade member defines a first notch and the second blade defines a second notch;

wherein the first spacing member extends into the first and second notches;

wherein the second blade member defines a third notch and the third blade member defines a fourth notch;

wherein the second spacing member extends into the third and fourth notches;

wherein the third blade member defines a fifth notch and the fourth blade member defines a sixth notch;

wherein the third spacing member extends into the fifth and sixth notches;

wherein the fourth blade member defines a seventh notch; and wherein the fourth spacing member extends into the seventh notch.

6. The apparatus of claim 5, wherein the spacing members are substantially spherical.

7. The apparatus of claim 1, further comprising a threaded shank for attaching the arrowhead to an arrow shaft.

8. The apparatus of claim 1, further comprising an arrow tip mounted to the member and having a segment that contacts the first blade member.

9. The apparatus of claim 1, wherein the second blade member is longer than the first blade member, the third blade member is longer than the second blade member, and the fourth blade member is longer than the third blade member.

* * * * *